United States Patent [19]

Bolton

[11] 3,983,860

[45] Oct. 5, 1976

[54] SLINGSHOT

[76] Inventor: Vernard D. Bolton, 2420 Terminal, Granite City, Ill. 62040

[22] Filed: Oct. 10, 1975

[21] Appl. No.: 618,641

[52] U.S. Cl. ..... 124/20 R; 24/115 K; 124/80

[51] Int. Cl.[2] ..... F41B 7/00

[58] Field of Search ..... 124/20 R, 20 A, 20 B, 124/80, 90; 24/73 A, 115 K, 115 B, 265 AL, 265 C; 403/181, 180, 53, 54; 63/2, 4, 21; D22/4, 5

[56] References Cited

UNITED STATES PATENTS

| | | | |
|---|---|---|---|
| 2,807,254 | 9/1957 | Stribling | 124/20 R |
| 3,306,278 | 2/1967 | Spatari | 124/20 A X |
| 3,517,657 | 6/1970 | Alban | 124/20 B |

*Primary Examiner*—Richard C. Pinkham
*Assistant Examiner*—William R. Browne
*Attorney, Agent, or Firm*—John D. Pope, III

[57] ABSTRACT

A slingshot having a crotch having two branches, one branch being longer than the other and the power bands are swiveled about the ends of the branches. The branches are substantially parallel to each other and to the handle of the slingshot.

5 Claims, 6 Drawing Figures

FIG. 1
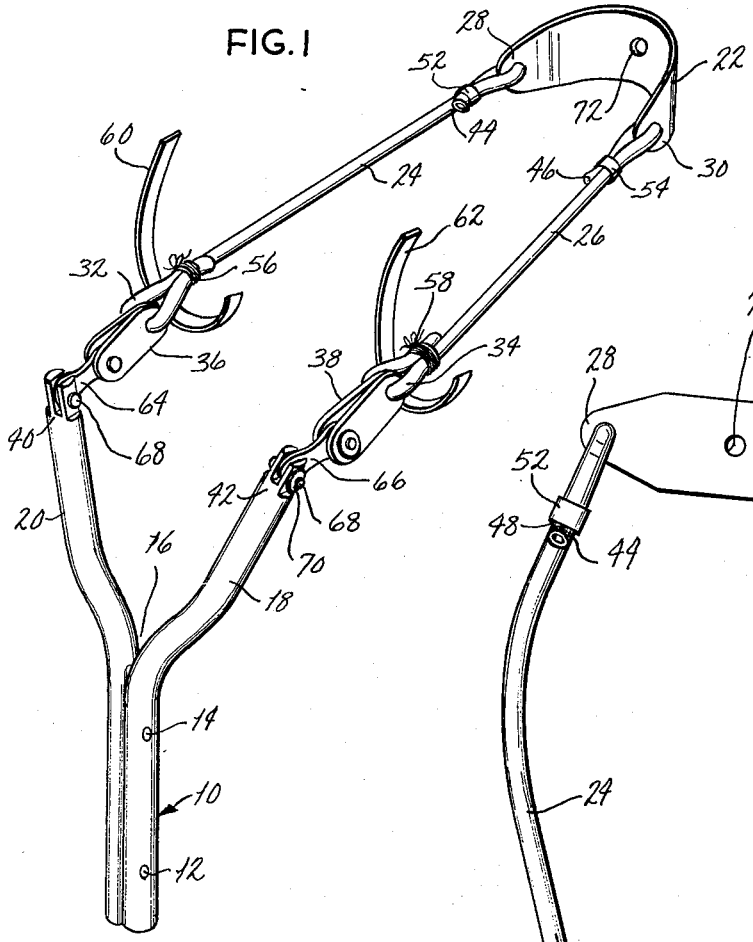
FIG. 3
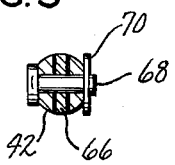
FIG. 4
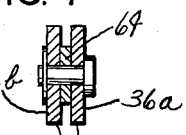
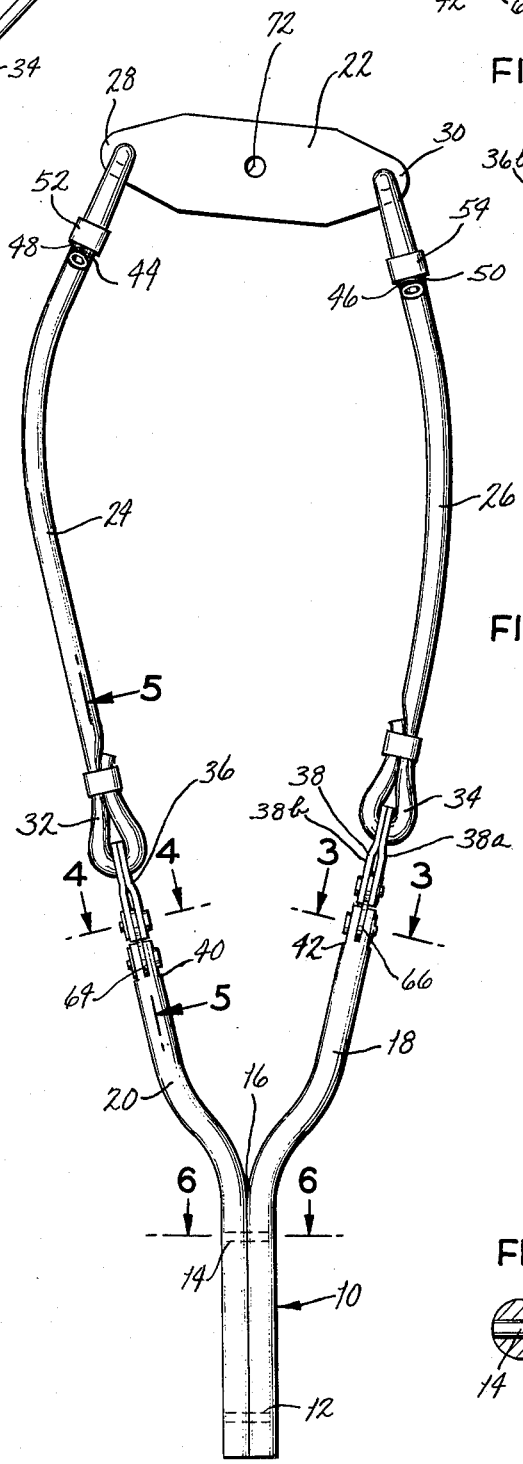
FIG. 2
FIG. 5
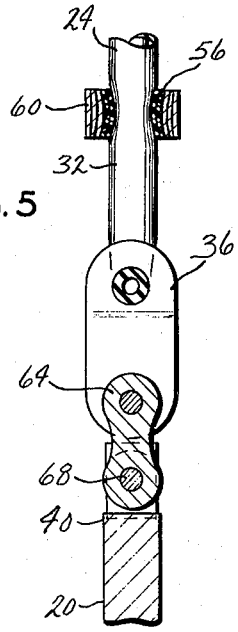
FIG. 6
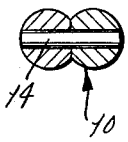

SLINGSHOT

This invention relates to an improved slingshot and more particularly to a construction which both improves accuracy of aim and is durable.

Among the objects of the present invention are the provision of a slingshot which permits accurate aim by the user; is durable over an extended period of usage and which is equally adaptable to use by right and left-handed shooters. Other objects and features will be in part apparent and in part pointed out hereinafter.

The invention accordingly comprises the constructions hereinafter described, the scope of the invention being indicated in the following claims.

In the accompanying drawings in which one of various possible embodiments of the invention is illustrated, FIG. 1 is an isometric view of a slingshot of the present invention extended ready for use with some parts opened up;

FIG. 2 is a plan view of the slingshot;

FIG. 3 is a section taken along line 3—3 on FIG. 2;

FIG. 4 is a section taken along line 4—4 on FIG. 2;

FIG. 5 is a section taken along line 5—5 on FIG. 2; and

FIG. 6 is a section taken along line 6—6 on FIG. 2.

Corresponding reference characters indicate corresponding parts throughout the drawings.

The slingshot of the present invention consists of a handle 10, made up of two metal rods, for example aluminum, joined together by rivets 12 and 14. Handle 10 separates at a crotch 16 into two arms 18 and 20. Arm 20 is shorter than arm 18 to enable accurate use and accurate aiming of the slingshot.

An ammunition pocket 22 formed of leather or other flexible material is joined to handle 10 through elastic members 24 and 26 formed of a material such as surgical rubber which is both elastic and sturdy. Members 24 and 26 are attached to opposite ends 28 and 30 of pocket 22 and at the opposite ends 32 and 34 to hinges 36 and 38, each consisting of two parts, **36*a* and 36*b* and 38*a* and 38*b* which in turn are indirectly attached to the ends of crotch 16, hinge 36 being attached to end 40 and hinge 38 to end 42 of crotch 16.**

To provide resiliency and yet reliability of operation the end 44 of member 24 and the end 46 of member 26 are held in the form of loops through pocket 22 by an elastic band such as rubber bands 48 and 50 which in turn are covered with a protective layer 52 and 54 such as electrical tape.

Loops at the other ends of members 24 and 26 are similarly held through holes in hinges 36 and 38, respectively, by rubber bands 56 and 58, respectively, which in turn are covered by electrical tape pieces 60 and 62.

Hinges 36 and 38 are held to the ends 40 and 42 of crotch 16 by steel hinges 64 and 66, respectively. While hinges 36 and 38 are preferably constructed of a resilient material such as leather, hinges 54 and 56 are preferably made of sturdy material such as steel. This construction enables hinges 36 and 38 to serve as shock absorbers while adding to the durability of members 24 and 26.

Hinges 64 and 66 are pivoted to ends 40 and 42 of crotch 16 by steel rivets 68 held in place by washers 70. Washers 70 permit easy rotation of hinges 36, 38, 64 and 66 about the rivets joining them to hinges 36 and 38 and to hinges 64 and 66.

To permit more accurate positioning of ammunition in slingshot pocket 22 this may be centrally drilled as at 72 to more accurately position the ammunition and improve accuracy.

The difference in the length of the arms 18 and 20 permits accurate sighting by the user and by merely reversing the position in which the slingshot is held easily adapts the unit to right-handed or left-handed users.

The flexible attachment of members 24 and 26 to the ends 40 and 42 of crotch 16 through hinges 36, 38, 64 and 66 gives the device not only excellent balance to improve the aim of the user but also affords great durability. A specific unit so constructed has been shot almost ten thousand times with release pressures of 15 to 17 pounds using one-half inch steel balls without exhibiting apparent wear while affording excellent aim accuracy.

The slingshot of the present invention is suitable for use over extended periods of time with improved effectiveness because of the strength and durability of the construction described.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A slingshot comprising a handle with a crotch at one end, a flexible pocket to receive ammunition, said crotch formed by a pair of arms which are approximately parallel to each other and to the handle and substantially straight at their ends remote from the handle, a pair of elastic members joining the pocket to the ends of the arms with one arm attached to one end of the pocket by one of the elastic members and the other arm attached to the other end of the pocket by the other elastic member, one of said arms being substantially shorter in length than the other, said arms coming together at said crotch and forming said handle.

2. A slingshot according to claim 1 in which the pocket is substantially non-elastic.

3. A slingshot according to claim 2 in which the arms retain their identity in said handle.

4. A slingshot according to claim 3 in which the elastic members are hinged to the arms.

5. A slingshot according to claim 4 in which the elastic members are attached to leather hinge fasteners which are hinged to the arms.

* * * * *